US010768648B2

(12) United States Patent
Lee et al.

(10) Patent No.: US 10,768,648 B2
(45) Date of Patent: Sep. 8, 2020

(54) POWER MANAGEMENT DEVICE AND ELECTRONIC DEVICE INCLUDING THE SAME

(71) Applicant: SAMSUNG ELECTRONICS CO., LTD., Suwon-si, Gyeonggi-do (KR)

(72) Inventors: Kyungsoo Lee, Yongin-si (KR); Junghun Heo, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/916,659

(22) Filed: Mar. 9, 2018

(65) Prior Publication Data

US 2018/0196455 A1 Jul. 12, 2018

Related U.S. Application Data

(63) Continuation of application No. 15/480,528, filed on Apr. 6, 2017, now Pat. No. 9,915,962.

(30) Foreign Application Priority Data

Jul. 27, 2016 (KR) ..... 10-2016-0095489

(51) Int. Cl.
*G05F 1/575* (2006.01)

(52) U.S. Cl.
CPC ..... *G05F 1/575* (2013.01)

(58) Field of Classification Search
CPC . G05F 1/59; G05F 1/563; G05F 1/595; G05F 1/61; G05F 1/614; G05F 1/575; G05F 1/465; G05F 1/56; G05F 1/562; G05F 1/565; G05F 1/573; G05F 1/5735
USPC ..... 323/266, 267, 269–270, 273–281
See application file for complete search history.

(56) References Cited

U.S. PATENT DOCUMENTS

| | | | | |
|---|---|---|---|---|
| 7,684,878 | B2 * | 3/2010 | Reindel | G06F 1/26 700/22 |
| 8,026,636 | B2 | 9/2011 | Oh | |
| 8,072,097 | B2 | 12/2011 | Ogura | |
| 8,354,828 | B2 | 1/2013 | Huang et al. | |
| 8,456,145 | B2 | 6/2013 | Fang | |
| 8,508,208 | B2 | 8/2013 | Klein | |
| 8,890,362 | B2 | 11/2014 | Kawasaki | |
| 9,088,176 | B2 | 7/2015 | Hendin et al. | |
| 2009/0153108 | A1 * | 6/2009 | Hendin | H02J 1/08 323/234 |
| 2009/0160251 | A1 | 6/2009 | Mok et al. | |
| 2010/0219687 | A1 * | 9/2010 | Oh | G05F 1/46 307/39 |
| 2014/0015507 | A1 | 1/2014 | Park et al. | |

(Continued)

FOREIGN PATENT DOCUMENTS

| | | |
|---|---|---|
| JP | 2007-244046 A | 9/2007 |
| JP | 2009-157820 A | 7/2009 |

*Primary Examiner* — Nguyen Tran
(74) *Attorney, Agent, or Firm* — Lee IP Law, PC

(57) ABSTRACT

A power management device includes at least one switching regulator to generate a conversion voltage from an input voltage, a plurality of low drop-out regulators to generate a plurality of output voltages from the conversion voltage, and a controller to estimate drop-out voltages of the low drop-out regulators based on output currents of the low drop-out regulators and to dynamically control the conversion voltage based on the estimated drop-out voltages.

11 Claims, 20 Drawing Sheets

(56) References Cited

U.S. PATENT DOCUMENTS

| | | | | |
|---|---|---|---|---|
| 2015/0130292 | A1 | 5/2015 | Yeon et al. | |
| 2015/0263615 | A1 | 9/2015 | Moon et al. | |
| 2017/0255213 | A1* | 9/2017 | Oikarinen | G06F 1/26 |

* cited by examiner

POWER MANAGEMENT DEVICE AND ELECTRONIC DEVICE INCLUDING THE SAME

CROSS-REFERENCE TO RELATED APPLICATIONS

This is a continuation application based on pending application Ser. No. 15/480,528, filed Apr. 6, 2017, the entire contents of which is hereby incorporated by reference.

Korean Patent Application No. 10-2016-0095489, filed on Jul. 27, 2016, and entitled, "Power Management Device and Electronic Device Including the Same," is incorporated by reference herein in its entirety.

BACKGROUND

1. Field

One or more embodiments described herein relate to a power management device and an electronic device including a power management device.

2. Description of the Related Art

A power management device may generate power voltages for an electronic device from an input voltage, received, for example, from a battery. The lifespan of the battery lifespan is limited. This may adversely affect device performance and user convenience.

SUMMARY

In accordance with one or more embodiments, a power management device includes at least one switching regulator to generate a conversion voltage from an input voltage; a plurality of low drop-out (LDO) regulators to generate a plurality of output voltages from the conversion voltage; and a controller to estimate drop-out voltages of the LDO regulators based on output currents of the LDO regulators and dynamically control the conversion voltage based on the estimated drop-out voltages.

In accordance with one or more other embodiments, an electronic device includes a power management device to provide a plurality of output voltages to drive a plurality of functional blocks based on an input voltage; and an application processor (AP) to determine an operation state of each of the functional blocks, generate a power control signal based on the operation state, and provide the generated power control signal to the power management device, wherein the power management device includes: at least one switching regulator to generate a conversion voltage from the input voltage; a plurality of low drop-out (LDO) regulators to generate a plurality of output voltages from the conversion voltage; and a controller to control the conversion voltage based on the power control signal.

In accordance with one or more other embodiments, an apparatus includes first logic to output a first signal to a plurality of low drop-out regulators; and second logic to generate a second signal based on a condition of one or more of the low drop-out regulators, wherein the first signal is to control outputs of the low drop-out regulators and wherein the first logic is to change the first signal based on the second signal from the second logic.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
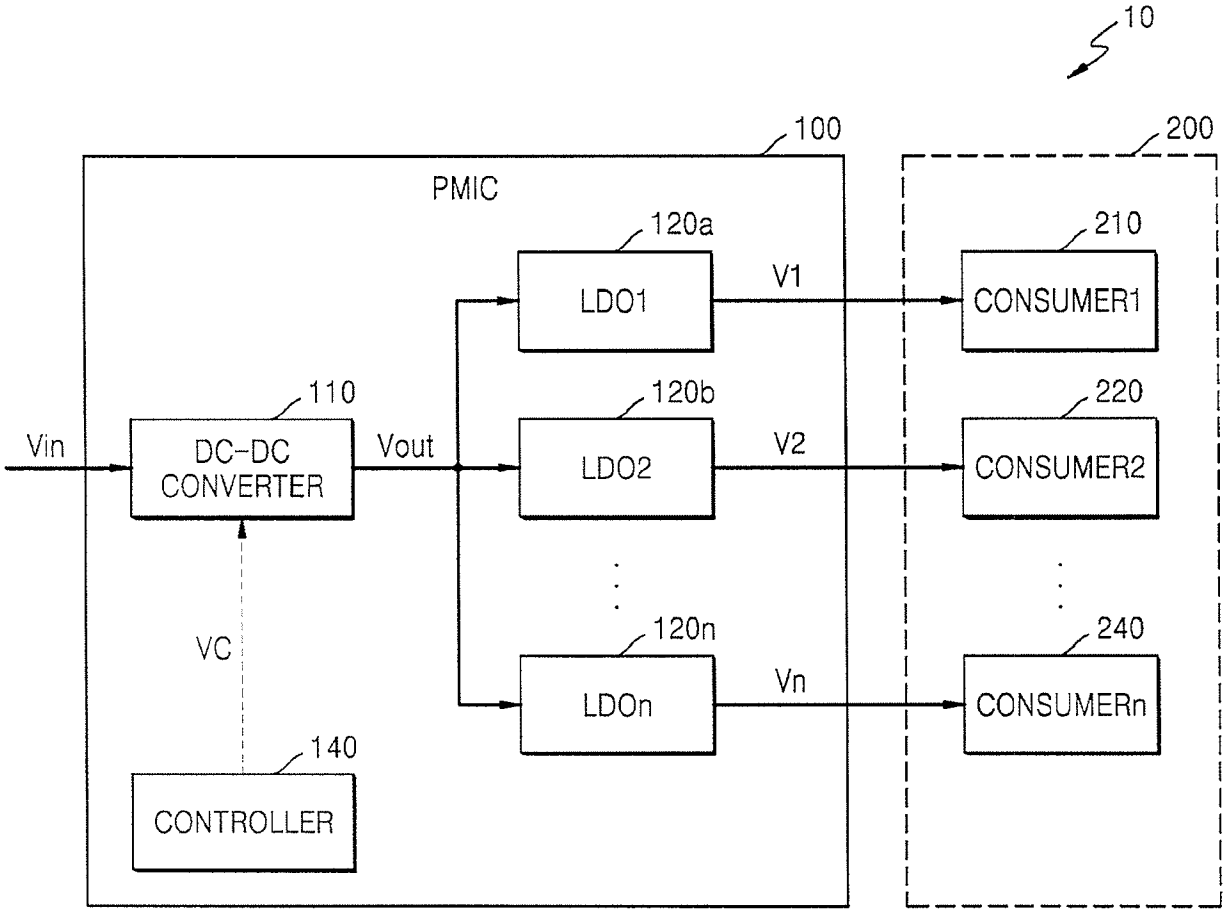
FIG. 1 illustrates an embodiment of an electronic device including a power management device.

FIG. 1 illustrates an embodiment of an electronic device 10 including a power management device 100. Referring to FIG. 1, the electronic device 10 may include the power management device 100 and a consumer group 200. The consumer group 200 may include a plurality of consumers 210 through 240. In an embodiment, the consumers 210 through 240 may be chips, modules, or other circuits in the electronic device 10. For example, the consumers 210 through 240 may be modems, application processors, memories, displays, and/or other circuits. The consumers 210 through 240 may also include operation blocks, functional blocks, or IP blocks in the electronic device 10. Examples of these include multimedia blocks, memory controllers, or other logic in the application processor. The consumers 210 through 240 may be referred to, for example, as consumption blocks or loads.

The power management device 100 may receive an input voltage Vin from a source (e.g., an external source) and generate a plurality of output voltages V1 through Vn for driving the consumers 210 through 240. The power management device 100 may include at least one first regulator 110, a plurality of second regulators 120*a* through 120*n*, and a controller 140. The at least one first regulator 110 and the second regulators 120*a* through 120*n* may be connected to each other, for example, in a multistep structure. In an embodiment, the power management device 100 may be a power management integrated circuit (PMIC).

The first regulator 110 may receive the input voltage Vin from an external voltage source, for example, a battery, and generate a conversion voltage Vout from the received input voltage Vin. The first regulator 110 may also dynamically change the conversion voltage Vout based on a voltage control signal VC. For example, the conversion voltage Vout may be dynamically changed according to output currents and/or operation states of the second regulators 120*a* through 120*n*.

In the present embodiment, when at least one of the consumers 210 through 240 is powered off (and thus at least one of the second regulators 120*a* through 120*n* is powered off), the conversion voltage Vout may be reduced. In the present embodiment, although all the consumers 210 through 240 are powered on, the conversion voltage Vout may also be changed according to the operation states of the consumers 210 through 240. For example, when one of the consumers 210 through 240 is in a standby or sleep state (and thus an output current of a corresponding one of the consumers 210 through 240 is reduced), the conversion voltage Vout may be reduced.

In an embodiment, the first regulator 110 may be a switching regulator that uses an energy storage component (e.g., a capacitor and an inductor) and an output stage to generate the conversion voltage Vout. For example, the first regulator 110 may be a DC-DC converter. The first regulator 110 is referred to as the DC-DC converter 110 below. The DC-DC converter 110 may be a step-up converter (for example, a boost converter) that coverts the low input voltage Vin to the high conversion voltage Vout, or a step-down converter (for example, a buck converter) that converts the high input voltage Vin to the low conversion voltage Vout.

The second regulators 120*a* through 120*n* may be commonly connected to the DC-DC converter 110, receive the conversion voltage Vout from the DC-DC converter 110, and generate a plurality of output voltages V1 through Vn from the conversion voltage Vout. The output voltages V1 through Vn may be different from each other and, for example, may be less than the conversion voltage Vout. The second regulators 120*a* through 120*n* may be, for example, linear regulators, e.g., low drop-out (LDO) regulators. For illustrative purposes, the second regulators 120*a* through 120*n* are referred to as the LDO regulators 120*a* through 120*n* below.

The DC-DC converter 110 may have a substantially uniform efficiency irrespective of input and output voltages. Each of the LDO regulators 120*a* through 120*n* may have a variable efficiency with respect to the input and output voltages. Efficiency of each of the LDO regulators 120*a* through 120*n* may correspond to a ratio of each of the output voltages V1 through Vn with respect to the conversion voltage Vout. For example, the efficiency of the LOD regulator 120*a* may be a ratio (e.g., V1/Vout) of the output voltage V1 with respect to the conversion voltage Vout. Thus, a reduction in the difference between the input and output voltages of the LDO regulators 120*a* through 120*n* may be performed to improve the efficiency of each of the LDO regulators 120*a* through 120*n*.

When the difference between the input and output voltages of LDO regulators 120*a* through 120*n* is large (e.g., above a predetermined level), the conversion efficiency of the entire power management device 100 may be improved when the DC-DC converter 110 is in front of the LDO regulators 120*a* through 120*n* and an output of the DC-DC converter 110 is used as an input of each of the LDO regulators 120*a* through 120*n*. Thus, for example, when the output voltages V1 through Vn of the LDO regulators 120*a* through 120*n* are different from each other, the conversion efficiency of the entire power management device 100 may be improved when DC-DC converters are respectively arranged in front of the LDO regulators 120*a* through 120*n*.

In one embodiment, the LDO regulators 120*a* through 120*n* may be grouped, and the DC-DC converter 110 may be shared by the grouped LDO regulators 120*a* through 120*n*, in order to reduce the area and manufacturing costs of the power management device 100. In this case, the difference between the input and output voltages of the LDO regulators 120*a* through 120*n* may be large (e.g., above a predetermined level) compared when the LDO regulators 120*a* through 120*n* and DC-DC converters are respectively arranged. Thus the conversion efficiency of the entire power management device 100 may be reduced. However, according to the present embodiment, the first regulator 110 may dynamically change the conversion voltage Vout based on the voltage control signal VC, thereby improving the conversion efficiency of the entire power management device 100.

The controller 140 may generate the voltage control signal VC for dynamically controlling the conversion voltage Vout output from the DC-DC converter 110. The voltage control signal VC may be provided to the DC-DC converter 110. In an embodiment, the controller 140 may generate the voltage control signal VC based on current output from the LDO regulators 120*a* through 120*n*, e.g., current consumed by the consumers 210 through 240. In an embodiment, the controller 140 may generate the voltage control signal VC based on operation states of the consumers 210 through 240. In an embodiment, the controller 140 may generate the voltage control signal VC based on the operation states of the LDO regulators 120*a* through 120*n*.

According to the present embodiment, the controller 140 may dynamically control the conversion voltage Vout output from the DC-DC converter 110 based on the output currents and/or operation states of the second regulators 120*a* through 120*n*. Accordingly, when the second regulators 120*a* through 120*n* having the output voltages V1 through Vn that are different from each other are commonly connected to the one DC-DC converter 110, the controller 140 may control the conversion voltage Vout that is output from the DC-DC converter 110 as a reduced or minimum voltage for operating the second regulators 120*a* through 120*n*.

Therefore, the efficiency of each of the LDO regulators 120*a* through 120*n* may be improved by reducing the difference between the input and output voltages of the LDO regulators 120*a* through 120*n*. As a result, the conversion efficiency of entire power management device 100 may be reduced.

Figure 2:
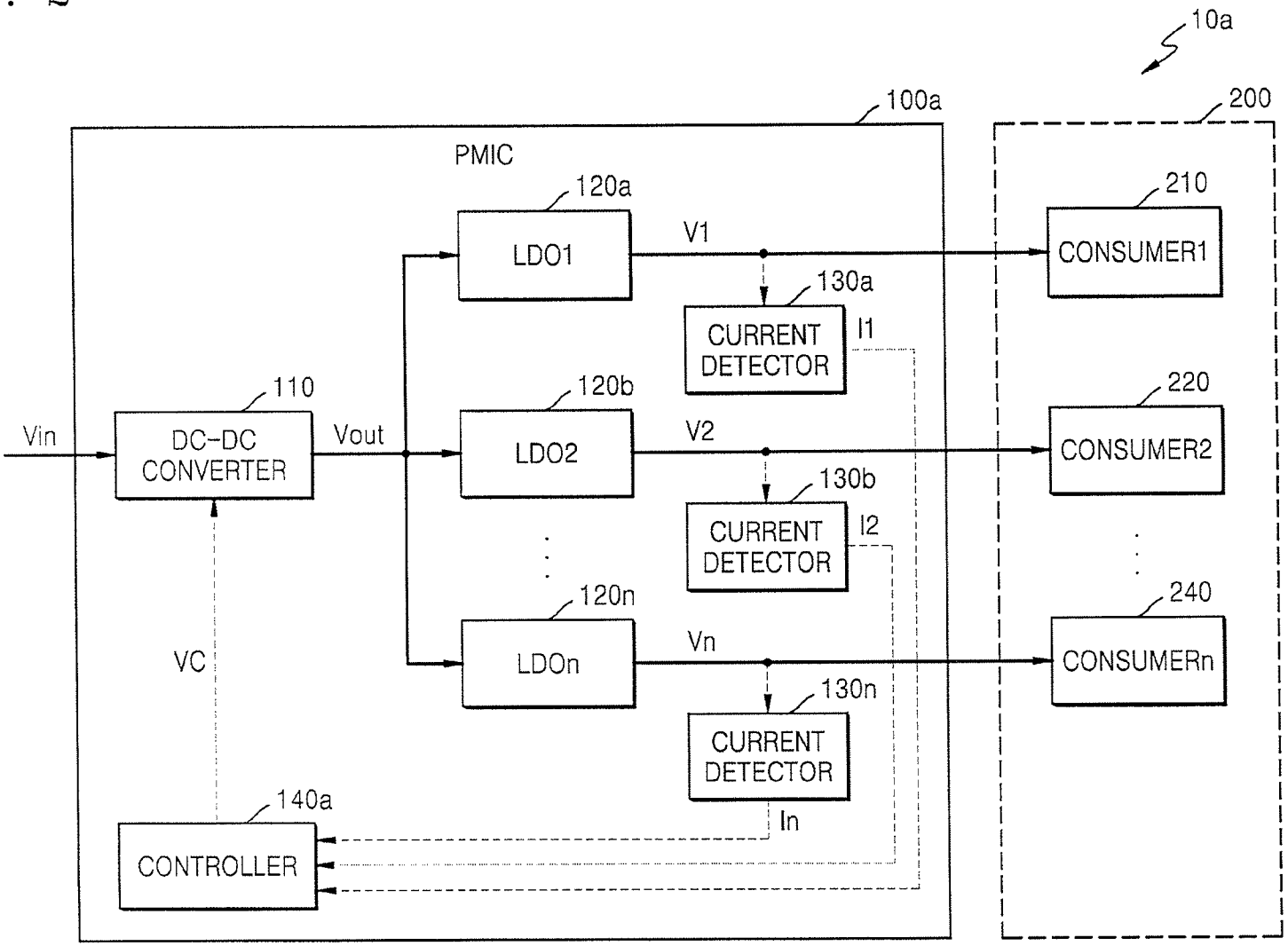
FIG. 2 illustrates another embodiment of an electronic device including a power management device.

FIG. 2 illustrates another embodiment of an electronic device 10*a* including a power management device 100*a*. Referring to FIG. 2, the power management device 100*a* may include the DC-DC converter 110, the plurality of LDO regulators 120*a* through 120*n*, a plurality of current detectors 130*a* through 130*n*, and a controller 140*a*. The power management device 100*a* may correspond to an implementation of the power management device 100 in FIG. 1. For example, the power management device 100*a* may further include the plurality of current detectors 130*a* through 130*n*, compared to the power management device 100 of FIG. 1.

The current detectors 130*a* through 130*n* may respectively detect current output from the LDO regulators 120*a* through 120*n*, e.g., consumption current of the consumers 210 through 240. The current information I1 through In may be generated based on the detected current to the controller 140a. According to the present embodiment, the current detectors 130a through 130n may be in the power management device 100a. In another embodiment, the current detectors 130a through 130n may be excluded from the power management device 100a and may provide the current information I1 through In to the controller 140a.

Figure 3:
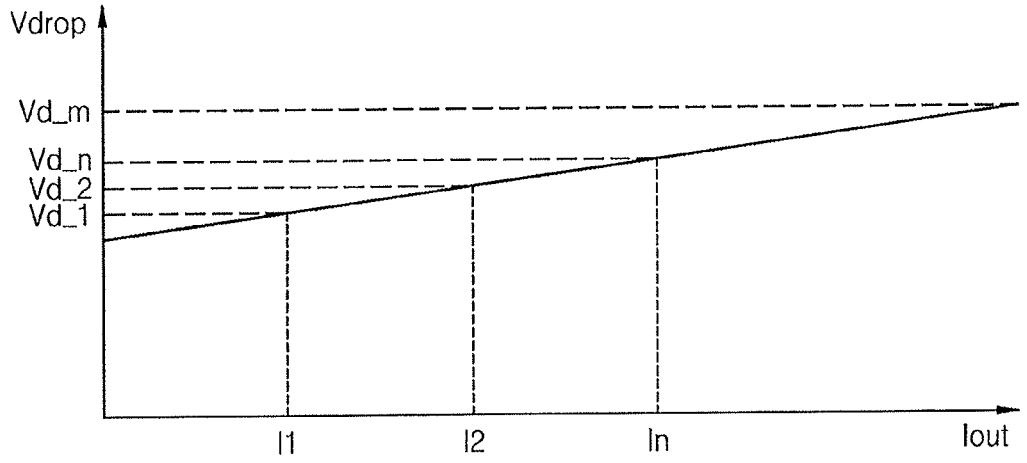
FIG. 3 illustrates an example of a relationship between an output current of a low drop-out (LDO) regulator and a drop-out voltage.

FIG. 3 illustrates an example of a relationship between an output current Iout of an LDO regulator and a drop-out voltage Vdrop. Referring to FIGS. 2 and 3, a horizontal axis indicates the output current Iout of the LDO regulator (e.g., the LDO regulators 120a through 120n), and a vertical axis indicates the drop-out voltage Vdrop. The drop-out voltage Vdrop may be a voltage drop generated in the LDO regulator and may correspond to a reduced or minimum difference between an input voltage and an output voltage. For example, the LDO regulator may normally operate only when the input voltage is greater than a sum of the output voltage and the drop-out voltage Vdrop.

A maximum drop-out voltage Vd_m may be a characteristic value predefined with respect to the LDO regulator. Thus, the input voltage of the LDO regulator may be greater than the sum of the output voltage and the maximum drop-out voltage Vd_m. However, if the output current Iout of the LDO regulator increases, the drop-out voltage Vdrop may increase. If the output current Iout of the LDO regulator decreases, the drop-out voltage Vdrop may decrease.

For example, a drop-output voltage Vd_1 corresponding to the first current information I1 may be less than a drop-out voltage Vd_2 corresponding to the second current information 12. The drop-out voltage Vd_2 corresponding to the second current information 12 may be less than a drop-out voltage Vd_n corresponding to the nth current information In. Thus, a reduction in the drop-out voltages Vd_1 through Vd_n may be estimated based on the first through nth current information I1 through In. Thus, the conversion voltage Vout output from the DC-DC converter 110 may be reduced.

Figure 4A:
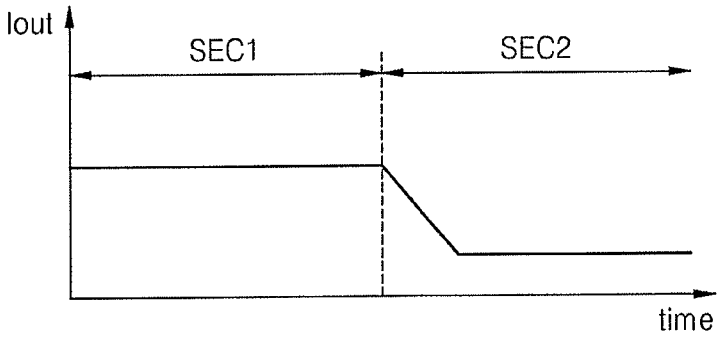
FIG. 4A illustrates an example of output current of an LDO regulator with respect to time.

FIG. 4A is a graph illustrating the output current Iout of an LDO regulator with respect to time according to an embodiment. In the graph, the horizontal axis indicates time and the vertical axis indicates the output current Iout of an LDO regulator (e.g., the LDO regulators 120a through 120n). Referring to FIG. 4A, the output current Tout may have a relatively high value in a first section SEC1 and a relatively low value in a second section SEC2. The current detectors 130a through 130n may detect output current of the LDO regulators 120a through 120n respectively connected to the current detectors 130a through 130n.

Figure 4B:
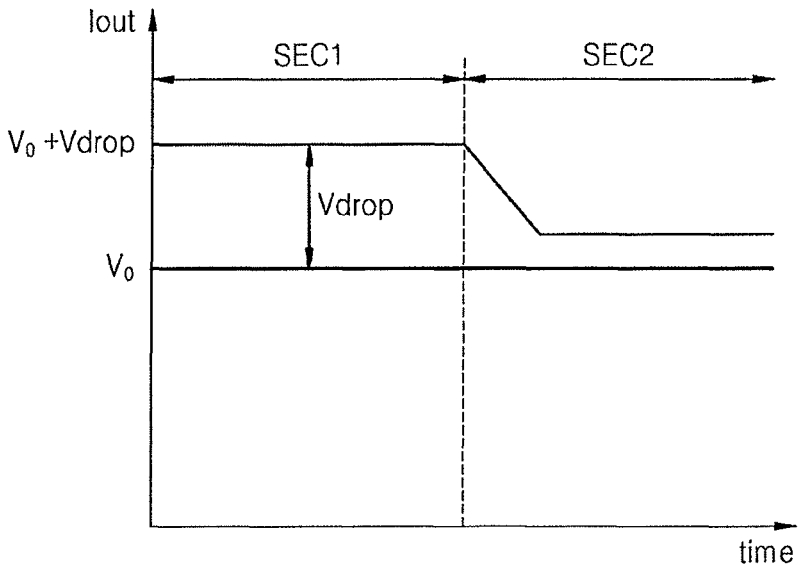
FIG. 4B illustrates an example of a conversion voltage output from a DC-DC converter with respect to time.

FIG. 4B is a graph illustrating the conversion voltage Vout that is output from the DC-DC converter 110 with respect to time according to an embodiment. In this graph, the horizontal axis indicates time and the vertical axis indicates the conversion voltage Vout of the DC-DC converter 110. Operations of the current detectors 130a through 130n and the controller 140a according to an embodiment will now be described with reference to FIGS. 2 through 4B below.

Referring to FIG. 4B, the controller 140a may receive the current information I1 through In from the current detectors 130a through 130n and estimate the drop-out voltage Vdrop of each of the LDO regulators 120a through 120n based on the received current information I1 through In.

For example, the controller 140a may estimate that the drop-out voltage Vdrop of the second section SEC2 is less than that of the first section SEC1, since the output current Iout of the second section SEC2 is less than that of the first section SEC1. In this regard, the controller 140a may estimate the drop-out voltage Vdrop of each of the LDO regulators 120a through 120n based on the graphs of FIGS. 3 and 4A.

Thereafter, the controller 140a may generate the voltage control signal VC based on the estimated drop-out voltage Vdrop. The voltage drop signal VC may be provided to the DC-DC converter 100, to thereby control the conversion voltage Vout output from the DC-DC converter 110. The conversion voltage Vout output from the DC-DC converter 110 may be obtained, for example, based on Equation 1.

$$Vout = V_0 + Vdrop_m \quad (1)$$

In Equation 1, $V_0$ corresponds to a maximum output voltage (e.g., a maximum value among the output voltages V1 through Vn of the LDO regulators 120a through 120n), and Vdrop_m corresponds to a drop-out voltage margin obtained based on the drop-out voltage Vdrop estimated with respect to each of the LDO regulators 120a through 120n.

In an embodiment, the drop-out voltage margin Vdrop_m may correspond to a drop-out voltage estimated with respect to an LDO regulator having the highest output voltage among the LDO regulators 120a through 120n. For example, if the first output voltage V1 is 1.8V, the second output voltage V2 is 1.7V, and the nth output voltage Vn is 1.6V, the maximum output voltage $V_0$ may be 1.8V. The drop-out voltage margin Vdrop_m may be a drop-out voltage estimated with respect to the first LDO regulator 120a providing the maximum output voltage $V_0$. For example, if the drop-out voltage estimated with respect to the first LDO regulator 120a is 0.1V, the conversion voltage Vout may be 1.9V (e.g., 1.8V+0.1V=1.9V).

In an embodiment, the drop-out voltage margin Vdrop_m may be obtained based on the sum of each output voltage and each corresponding estimated drop-out voltage. For example, if the first output voltage V1 is 1.8V, the second output voltage V2 is 1.7V, the nth output voltage Vn is 1.6V, the drop-out voltage estimated with respect to the first LDO regulator 120a is 0.1V, a drop-out voltage estimated with respect to the second LDO regulator 120b is 0.3V, and a drop-out voltage estimated with respect to the nth LDO regulator 120n is 0.5V, the maximum output voltage $V_0$ may be 1.8V. The sum of the output voltage V1 and the drop-out voltage estimated with respect to the first LDO regulator 120a may be 1.9V. The sum of the output voltage V2 and the drop-out voltage estimated with respect to the second LDO regulator 120b may be 2.0V. the sum of the output voltage Vn and the drop-out voltage estimated with respect to the nth LDO regulator 120n may be 2.1V. In this regard, the drop-out voltage margin Vdrop_m may be 0.3V and the conversion voltage Vout may be 2.1V (e.g., 1.8V+0.3V=2.1V).

In one embodiment, the controller 140a may determine the drop-out voltage margin Vdrop_m based on the output voltages V1 through Vn of the LDO regulators 120a through 120n, output voltages of the LDO regulators 120a through 120n, or drop-out voltages estimated with respect to the LDO regulators 120a through 120n, so that the conversion efficiency of the entire power management device 100 may be improved.

Figure 5:
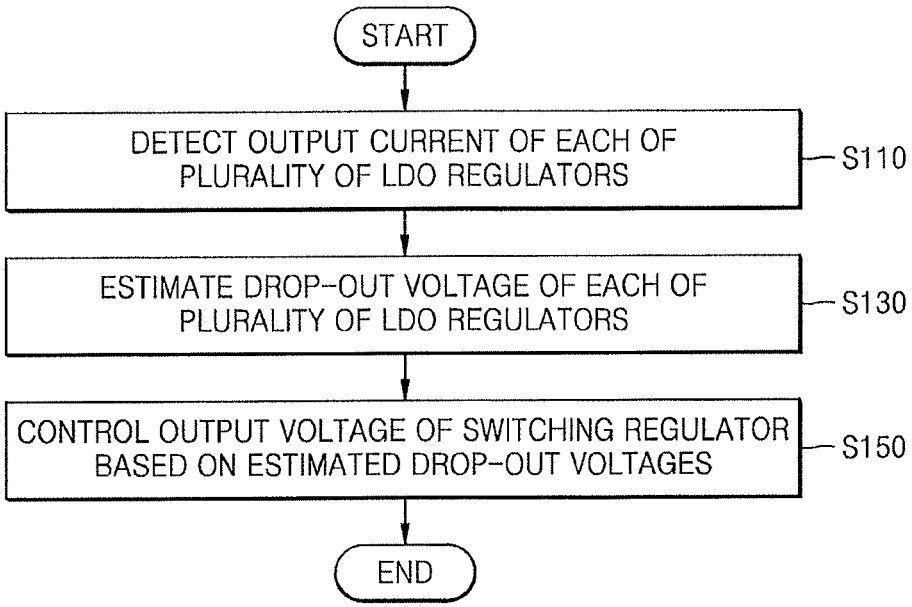
FIG. 5 illustrates an embodiment of a control method performed by a power management device.

FIG. 5 illustrates an embodiment of a control method performed by a power management device. In this embodiment, the power management device may include regulators with a multistep structure. The method may control an output voltage of a front regulator based on consumption current of a rear regulator. Also, the control method may be time-serially performed by the power management device 100*a* of FIG. 2. The descriptions for FIGS. 2 through 4B may apply to the present embodiment.

Referring to FIG. 5, in operation S110, an output current of each of a plurality of LDO regulators may be detected. For example, the current detectors 130*a* through 130*n* may respectively detect an output current of each of the LDO regulators 120*a* through 120*n*. In operation S130, a drop-out voltage of each of the LDO regulators may be estimated. For example, the controller 140*a* may estimate the drop-out voltage of each of the LDO regulators 120*a* through 120*n* based on the output current of each of the LDO regulators 120*a* through 120*n*. In operation S150, an output voltage of a switching regulator may be controlled based on the estimated drop-out voltages. For example, the controller 140*a* may control the conversion voltage Vout output from the DC-DC converter 110 based on the estimated drop-out voltages.

Figure 6:
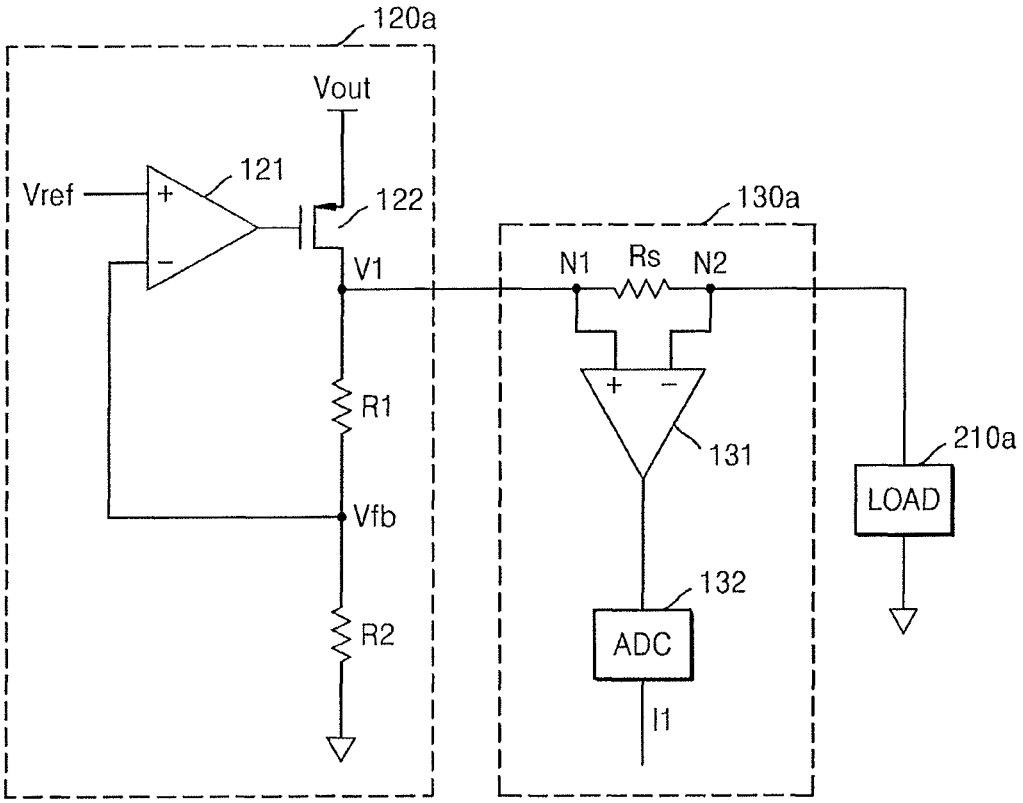
FIG. 6 illustrates an embodiment of an LDO regulator and a current detector.

FIG. 6 illustrates an embodiment of the LDO regulator 120*a* and the current detector 130*a*. The structures of the LDO regulator 120*a* and the current detector 130*a* of FIG. 6 may apply to the LDO regulators 120*b* through 120*n* and the current detectors 130*b* through 130*n*.

Referring to FIG. 6, the LDO regulator 120*a* may include an amplifier 121, a transistor 122, and first and second resistors R1 and R2. The amplifier 121 may include a first input terminal (for example, a + input terminal) that receives a reference voltage Vref and a second input terminal (for example, a − input terminal) that receives a feedback voltage Vfb between the first and second resistors R1 and R2. The amplifier 121 may amplify the difference between the reference voltage Vref and the feedback voltage Vfb. In one embodiment, the transistor 122 may be a PMOS transistor including a gate to receive an output of the amplifier 121, a source to receive the output voltage Vout of the DC-DC converter 110*d*, and a drain providing the output voltage V1.

The current detector 130*a* may be connected between the LDO regulator 120*a* and a load 210*a* and may detect the current Iout output from the LDO regulator 120*a*, e.g., a current consumed by the load 210*a*. The load 210*a* may correspond to the consumer 210. The current detector 130*a* may include, for example, a sense resistor Rs, an amplifier 131, and an analog/digital converter (ADC) 132.

The sense resistor Rs may be connected between a first node N1 and a second node N2 and may be, for example, about 0.001Ω. The amplifier 131 may include a first input terminal (for example, a + input terminal) that receives a voltage of the first node N1 and a second input terminal (for example, a − input terminal) that receives a voltage of the second node N2. The amplifier 131 may amplify the difference between the voltage of the first node N1 and the voltage of the second node N2 caused by current flowing through the sense resistor Rs. The ADC 132 may perform ADC conversion on an output of the amplifier 131 to generate the current information I1. The generated current information I1 may be provided to the controller 140*a*.

Figure 7:
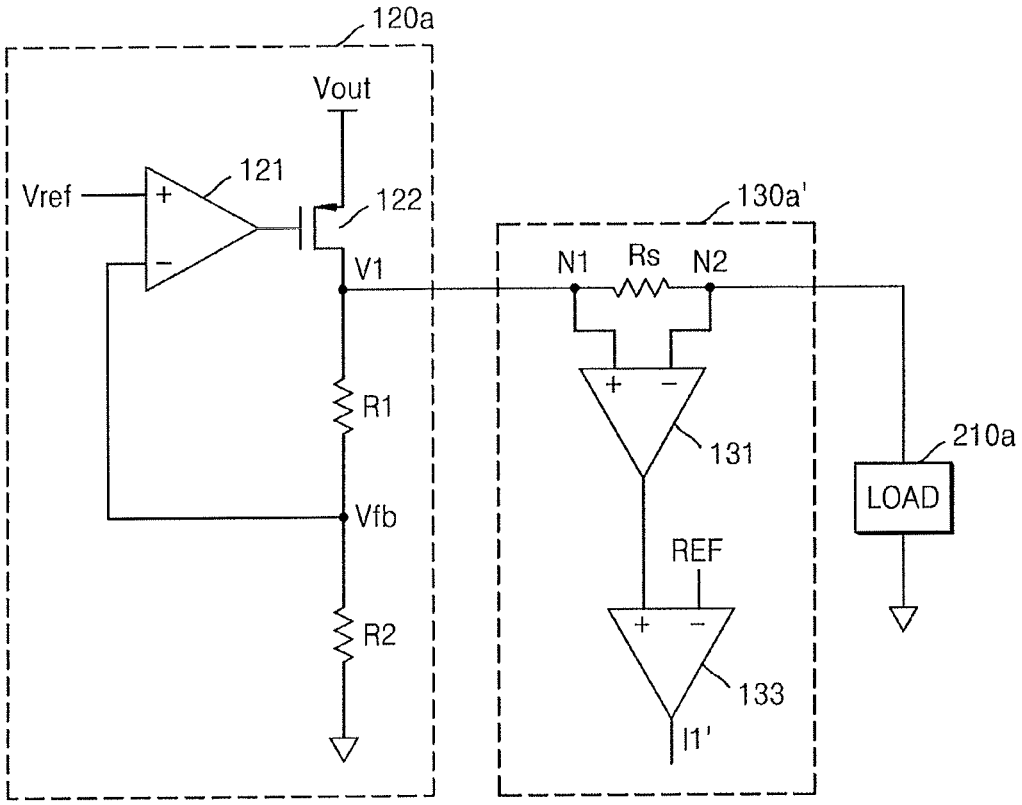
FIG. 7 illustrates another embodiment of an LDO regulator and current detector.

FIG. 7 illustrates another embodiment of the LDO regulator 120*a* and a current detector 130*a*'. Referring to FIG. 7, the current detector 130*a*' may include the sense resistor Rs, the amplifier 131, and a comparator 133, and may be a modification of the current detector 130*a* of FIG. 6. The comparator 133 may compare an output of the amplifier 131 and a reference signal REF and provide a comparison result to the controller 140*a* as the current information I1. The current information I1 may be output as 0 or 1.

Figure 8:
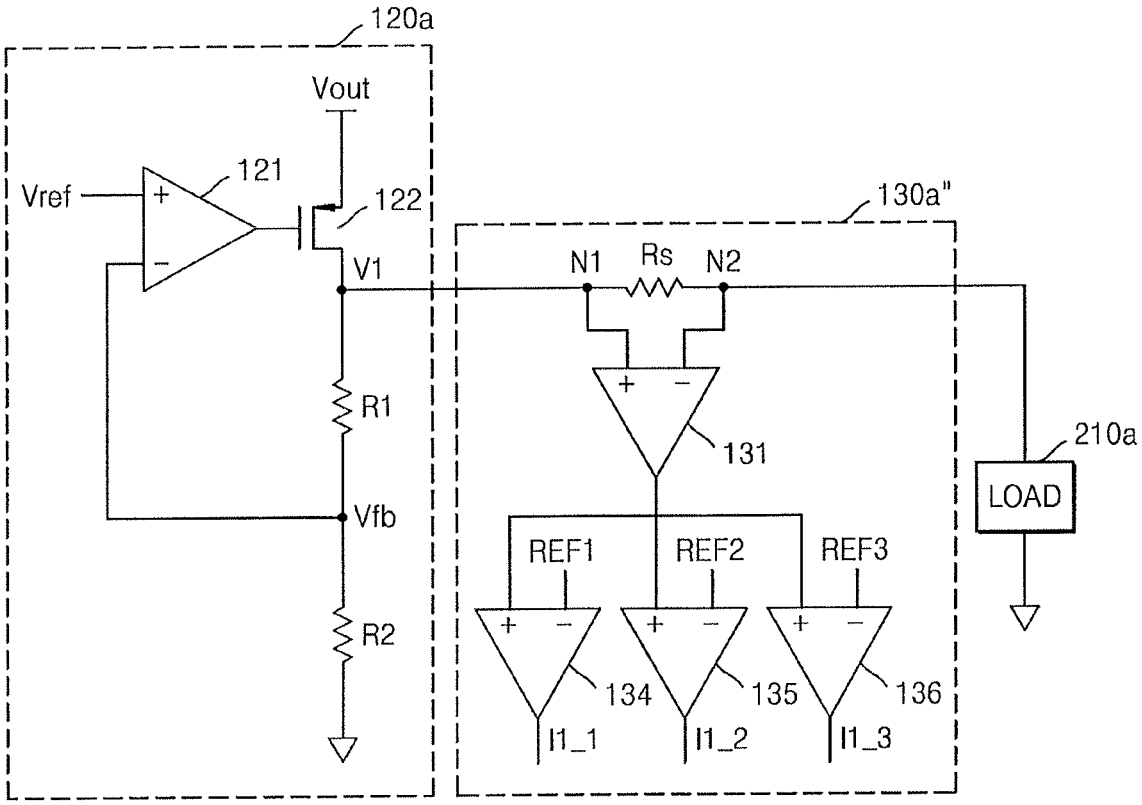
FIG. 8 illustrates another embodiment of an LDO regulator and current detector.

FIG. 8 illustrates another embodiment of the LDO regulator 120*a* and a current detector 130*a*" according to an embodiment. Referring to FIG. 8, the current detector 130*a*" may include the sense resistor Rs, the amplifier 131, and a plurality of comparators 134 through 136, and may be a modification of the current detector 130*a*' of FIG. 7. The first comparator 134 may compare an output of the amplifier 131 and a first reference signal REF1 and generate a first comparison result I1_1. The second comparator 135 may compare the output of the amplifier 131 and a second reference signal REF2 and generate a second comparison result I1_2. The third comparator 136 may compare the output of the amplifier 131 and a third reference signal REF3 and generate a third comparison result I1_3. The first through third comparison results I1_1 through I1_3 may be provided to the controller 140*a* as current information. The current information may be output as a digital signal of n (e.g., 3) bits. In another embodiment, the current information may be output as a digital signal of more or less than three bits, for example, based on the number of comparators.

Figure 9:
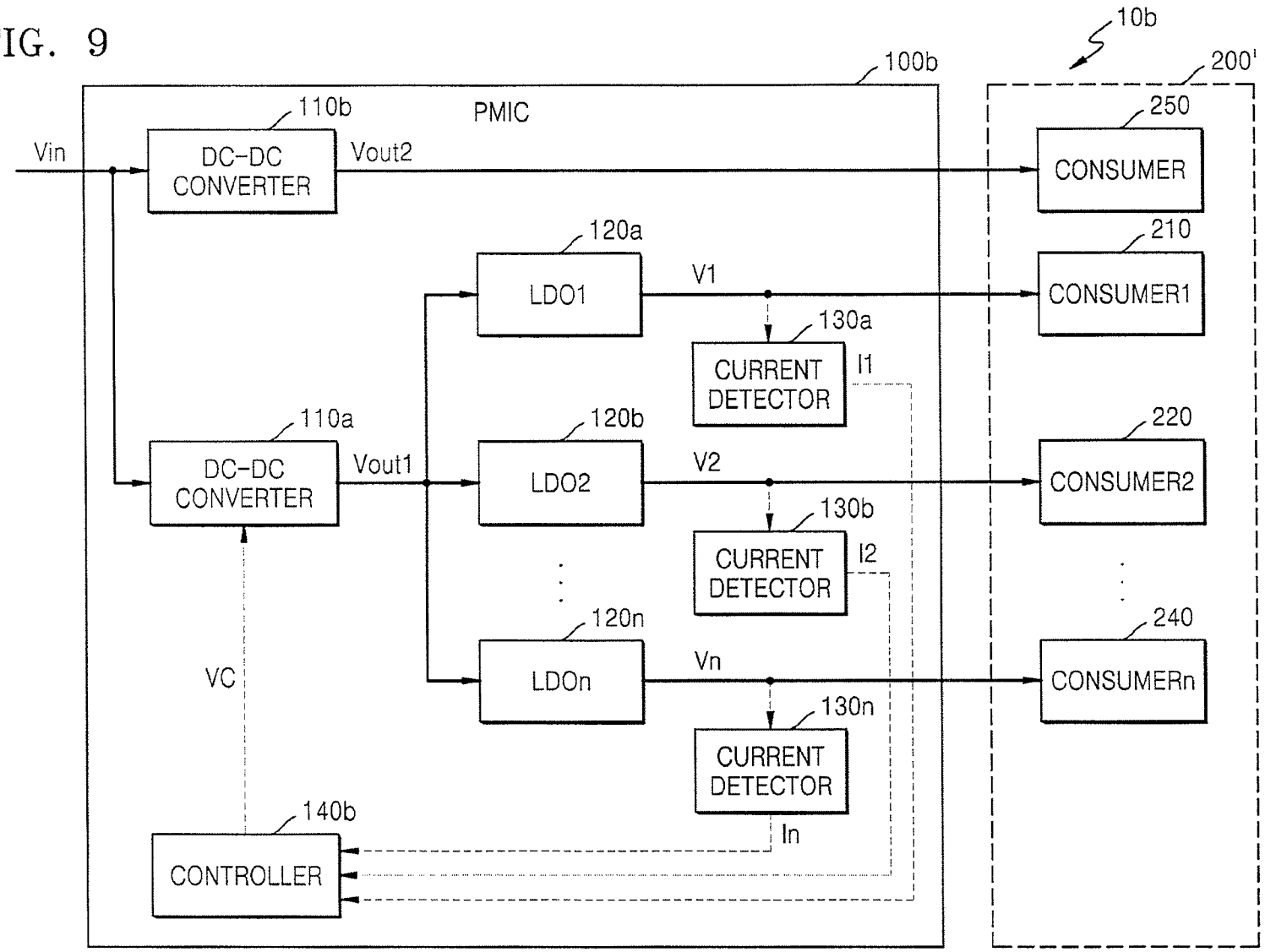
FIGS. 9-11 illustrate examples of electronic devices including power management devices.

FIG. 9 illustrates an embodiment of an electronic device 10*b* including a power management device 100*b*. Referring to FIG. 9, the power management device 100*b* may include first and second DC-DC converters 110*a* and 110*b*, the LDO regulators 120*a* through 120*n*, the current detectors 130*a* through 130*n*, and a controller 140*b*. The first DC-DC converter 110*a*, LDO regulators 120*a* through 120*n*, current detectors 130*a* through 130*n*, and controller 140*b* may be similar, for example, to those in FIG. 2.

In the present embodiment, the power management device 100*b* may include the first and second DC-DC converters 110*a* and 110*b*. The first DC-DC converter 110*a* may generate a first conversion voltage Vout1 from the input voltage Vin. The second DC-DC converter 110*b* may generate a second conversion voltage Vout2 from the input voltage Vin. In one embodiment, the power management device 100*b* may include three or more DC-DC converters.

The first DC-DC converter 110*a* may variably generate the first conversion voltage Vout1 based on the voltage control signal VC from the controller 140*b*, and may provide the generated first conversion voltage Vout1 to the LDO regulators 120*a* through 120*n*. The second DC-DC converter 110*b* may directly provide the second conversion voltage Vout2 that is consistent to the consumer 250. Accordingly, the power management device 100*b* may provide the second conversion voltage Vout2 and the output voltages V1 through Vn through output terminals.

Figure 10:
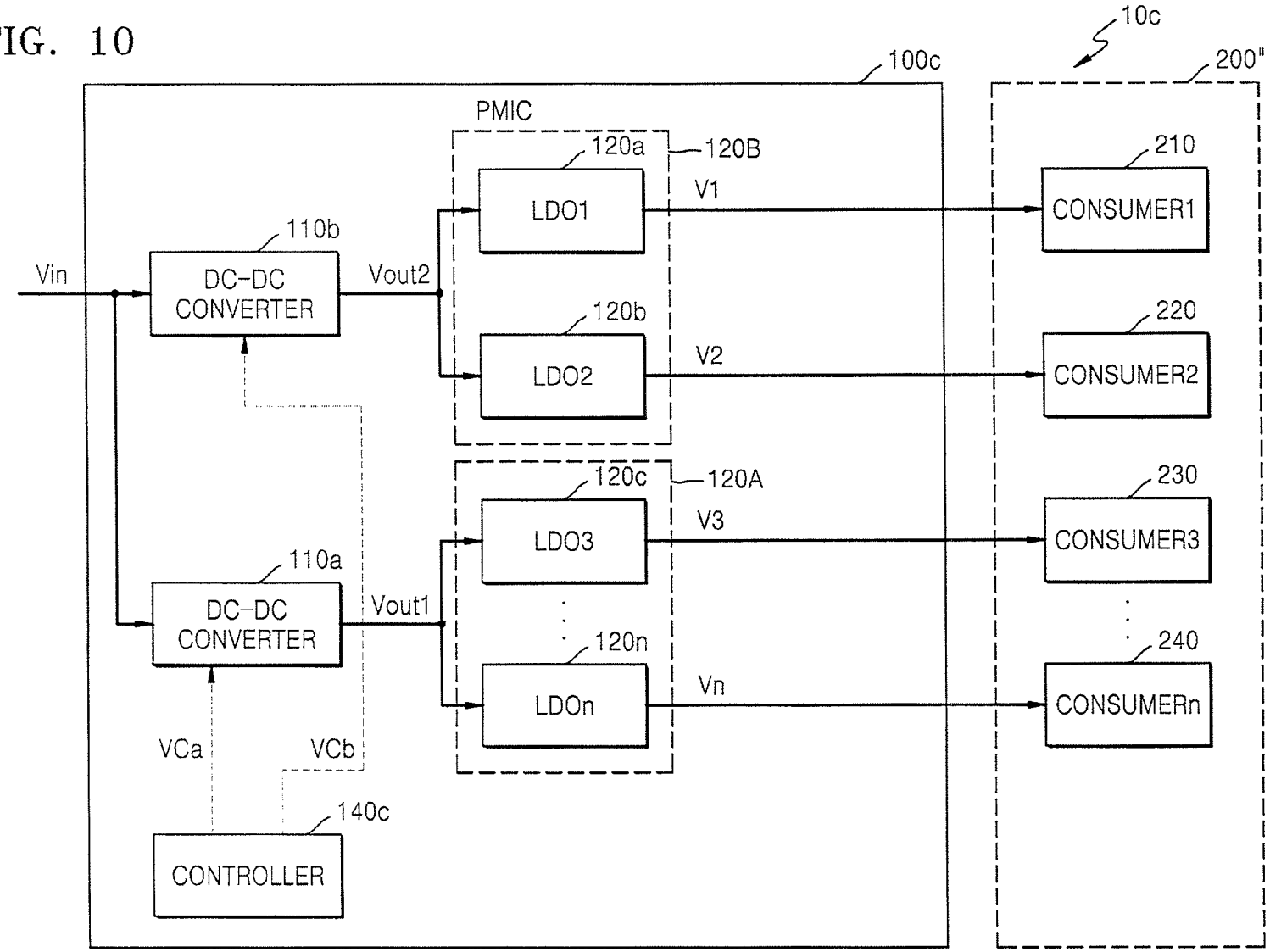

FIG. 10 illustrates an embodiment of an electronic device 10*c* including a power management device 100*c*. Referring to FIG. 10, the power management device 100*c* may include the first and second DC-DC converters 110*a* and 110*b*, the LDO regulators 120*a* through 120*n*, and a controller 140*c*. The first and second DC-DC converters 110*a* and 110*b* may respectively generate the first and second conversion voltages Vout1 and Vout2 from the input voltage Vin. The first and second conversion voltages Vout1 and Vout2 may be dynamically changed based on first and second voltage control signals VCa and VCb. For example, a voltage level of the first conversion voltage Vout1 may be greater than a voltage level of the second conversion voltage Vout2.

Among the plurality of LDO regulators 120*a* through 120*n*, the third and nth LDO regulators 120*c* and 120*n* may be in a first LDO regulator group 120A. The first and second LDO regulators 120*a* and 120*b* may be in a second LDO regulator group 120B. The number of LDO regulator groups may correspond to the number of DC-DC converters in the power management device 100*c*. In the present embodiment, since the power management device 100*c* includes the two DC-DC converters 110*a* and 110*b*, the number of the LDO regulator groups 120A and 120B may be 2. The number of LDO regulator groups may different, for example, based on a different number of DC-DC converters in the power management device 100*c*.

The controller 140*c* may estimate drop-out voltages of the third through nth LDO regulators 120*c* through 120*n* based on output currents of the first LDO regulator group 120A and generate a first voltage control signal VCa based on the estimated drop-out voltages. The output currents of the first LDO regulator group 120A may be detected from inside or outside the power management device 100*c*. Thereafter, the controller 140*c* may provide the first control voltage signal VCa to the first DC-DC converter 110*a*. Accordingly, the controller 140*c* may control the first conversion voltage Vout1 to be greater than or equal to the sum of a maximum output voltage of the first LDO regulator group 120A and a drop-out voltage margin.

The controller 140*c* may also estimate drop-out voltages of the first and second LDO regulators 120*a* and 120*b* based on output currents of the second LDO regulator group 120B and generate a second voltage control signal VCb based on the estimated drop-out voltages. The output currents of the second LDO regulator group 120B may be detected from inside or outside the power management device 100*c*. Thereafter, the controller 140*c* may provide the second control voltage signal VCb to the second DC-DC converter 110*b*. Accordingly, the controller 140*c* may control the second conversion voltage Vout2 to be greater than or equal to the sum of a maximum output voltage of the second LDO regulator group 120B and a drop-out voltage margin.

The first DC-DC converter 110*a* may variably generate the first conversion voltage Vout1 based on the first voltage control signal VCa from the controller 140*c* and provide the generated first conversion voltage Vout1 to the first LDO regulator group 120A. The second DC-DC converter 110*b* may variably generate the second conversion voltage Vout2 based on the second voltage control signal VCb from the controller 140*c* and provide the generated second conversion voltage Vout2 to the second LDO regulator group 120B.

Figure 11:
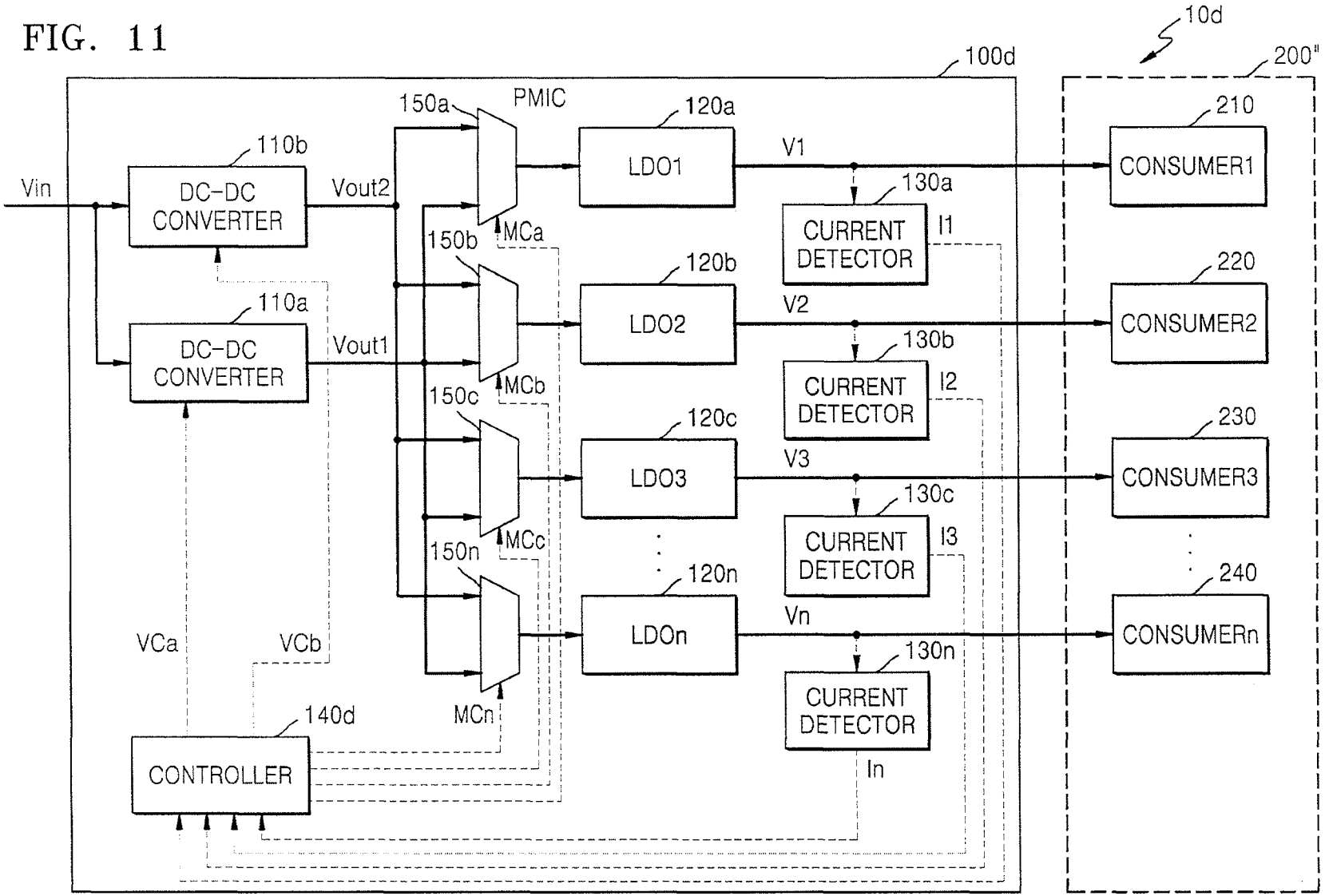

FIG. 11 illustrates an embodiment of an electronic device 10*d* including a power management device 100*d*. Referring to FIG. 11, the power management device 100*d* may include the first and second DC-DC converters 110*a* and 110*b*, the first through nth LDO regulators 120*a* through 120*n*, the first through nth current detectors 130*a* through 130*n*, a controller 140*d*, and first through nth selection circuits 150*a* through 150*n*. The power management device 100*d* may be a modification of FIG. 10.

The first through nth LDO regulators 120*a* through 120*n* may respectively generate the first through nth output voltages V1 through Vn from the first conversion voltage Vout1 or the second conversion voltage Vout2. In the present embodiment, the first through nth LDO regulators 120*a* through 120*n* may be identified as first and second LDO regulator groups. For example, LDO regulators in the first LDO regulator group may receive the first conversion voltage Vout1, and LDO regulators in the second LDO regulator group may receive the second converse voltage Vout2. In the present embodiment, the first and second LDO regulator groups may also be changed in real time. For example, the third LDO regulator 120*c* may be initially included in the first LDO regulator group and may be changed to the second regulator group during operation. This may be described, for example, with reference to FIGS. 12A and 12B.

The first through nth current detectors 130*a* through 130*n* may be respectively connected to the first through nth LDO regulators 120*a* through 120*n*, and may detect output current of each of the first through nth LDO regulators 120*a* through 120*n*, e.g., consumption current of the consumers 210 through 240. The first through nth current detectors 130*a* through 130*n* may generate the current information I1 through In based on the detected current. The current information I1 through In may be provided to the controller 140*d*.

The controller 140*d* may receive the current information I1 through In and generate the first and second voltage control signals VCa and VCb based on the received current information I1 through In. Operation of generating the first and second voltage control signals VCa and VCb may be substantially the same as described with reference to FIG. 10. The controller 140*d* may also generate first through nth selection control signals MCa through MCn based on the current information I1 through In. For example, the controller 140*d* may estimate drop-out voltages of the first through nth LDO regulators 120*a* through 120*n* based on the received current information I1 through In, and may generate the first through nth selection control signals MCa through MCn based on the estimated drop-out voltages, thereby controlling connections between the first and second DC-DC converters 110*a* and 110*b* and the first through nth LDO regulators 120*a* through 120*n*.

The first through nth selection circuits 150*a* through 150*n* may be respectively arranged in front of the first through nth LDO regulators 120*a* through 120*n*. The first through nth selection circuits 150*a* through 150*n* may receive the first and second conversion voltage Vout1 and Vout2 respectively output from the first and second DC-DC converters 110*a* and 110*b*, select one of the first and second conversion voltage Vout1 and Vout2 based on the first through nth selection control signals MCa through MCn, and respectively provide the selected conversion voltage Vout1 or Vout2 to the first through nth LDO regulators 120*a* through 120*n*. In an embodiment, the first through nth selection circuits 150*a* through 150*n* may be multiplexers. The number of input terminals of multiplexers may correspond to the number of DC-DC converters in the power management device 100*d*.

Figure 12A:
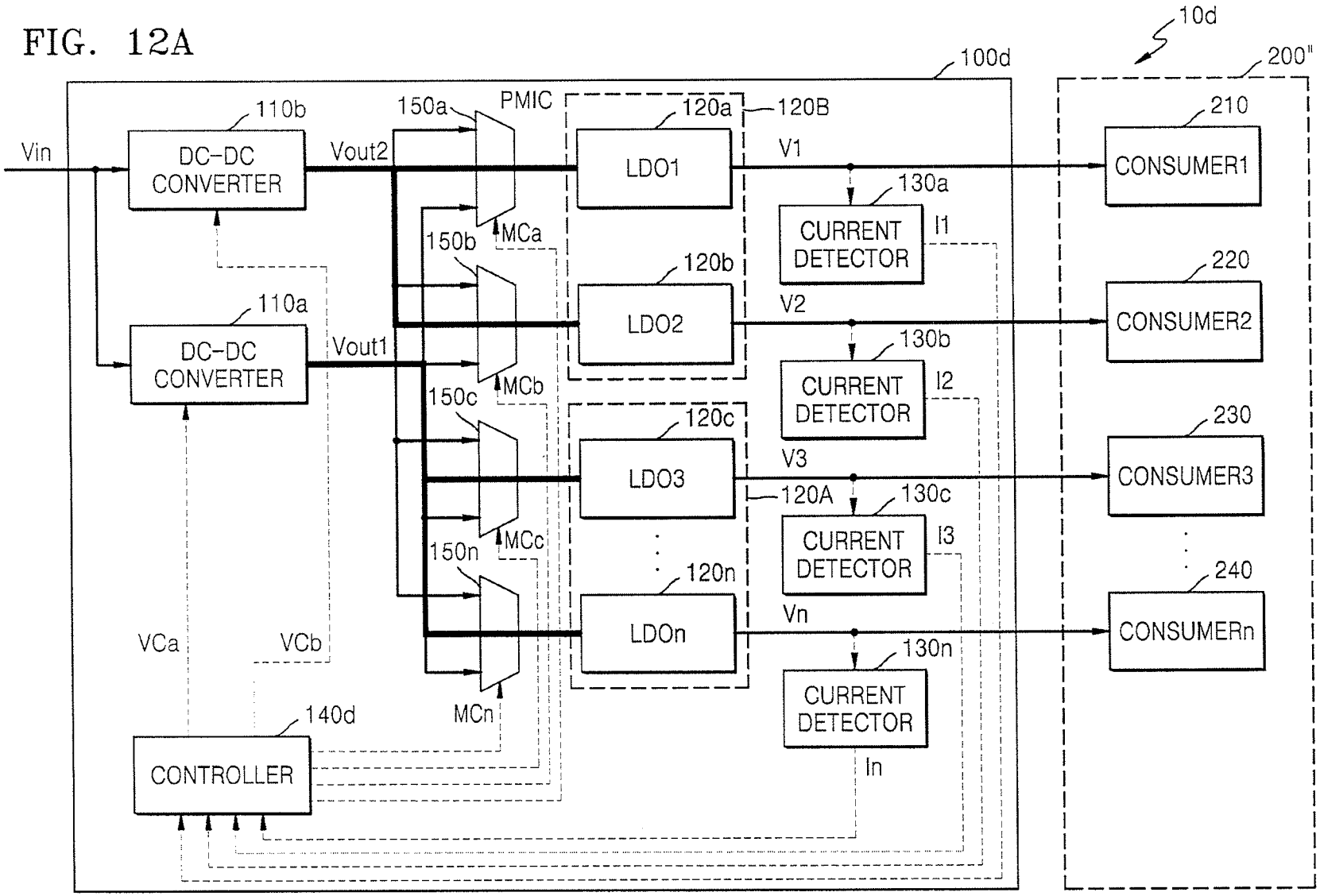
FIGS. 12A and 12B illustrate embodiments of connections between DC-DC converters and LDO regulators that are variable depending on output currents of LDO regulators in the electronic device of FIG. 11.
Figure 12B:
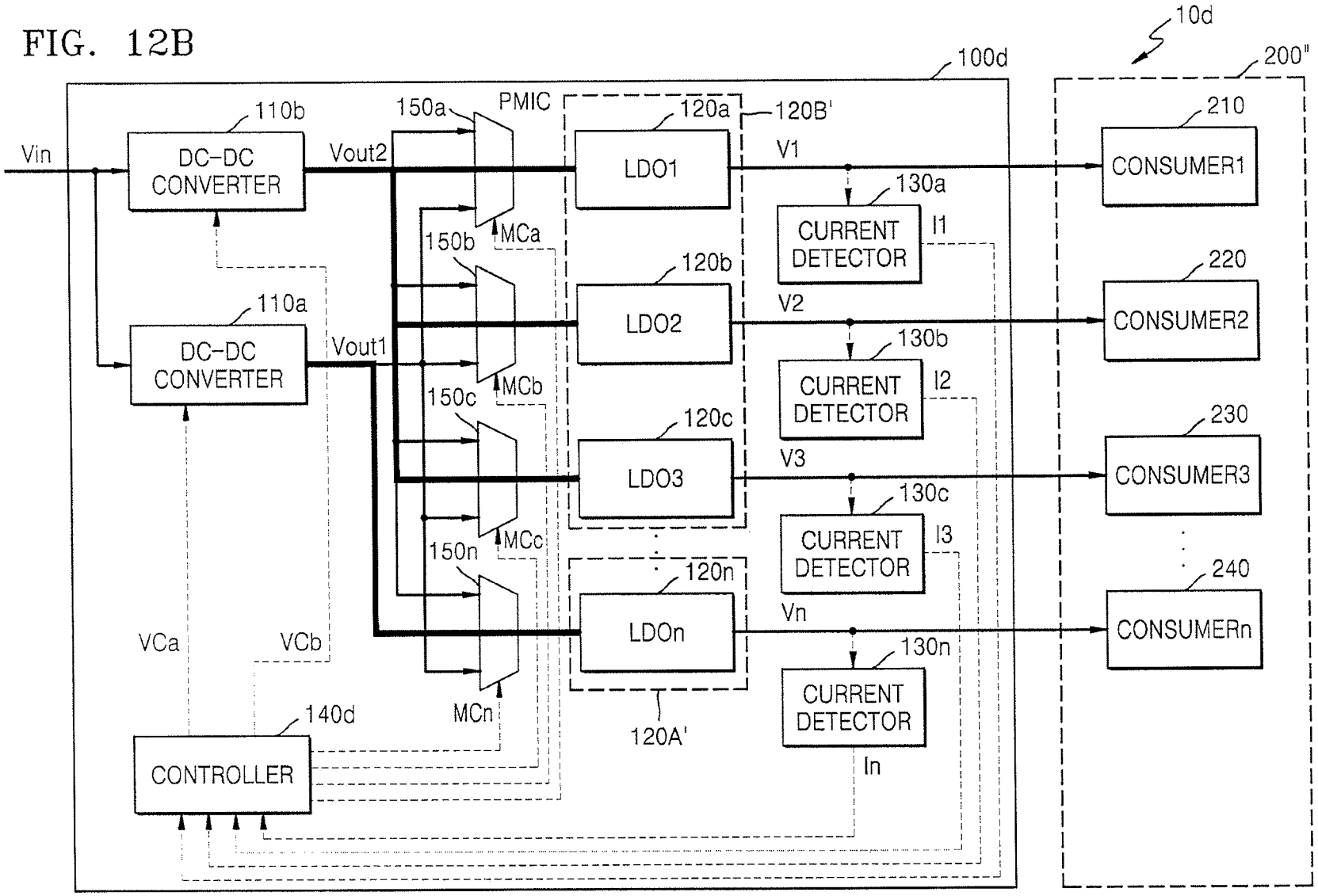

FIGS. 12A and 12B illustrates an embodiment of the electronic device 10*d* of FIG. 11 for describing connections between the DC-DC converters 110*a* and 110*b* and the LDO regulators 120*a* through 120*n* that are variable depending on output currents of the LDO regulators 120*a* through 120*n*.

Referring to FIG. 12A, the controller 140*d* may generate the first through nth selection control signals MCa through MCn based on a maximum drop-out voltage (for example, Vd_m of FIG. 3) of each of the first through nth LDO regulators 120*a* through 120*n* and the output voltages V1 through Vn during an initial operation of the electronic device 10*d*. The first and second LDO regulators 120*a* and 120*b* may be in the second LDO regulator group 120E and the third and nth LDO regulators 120*c* and 120*n* may be in the first LDO regulator group 120A according to the first through nth selection control signals MCa through MCn.

The first and second selection control signals MCa and MCb may indicate, for example, selection of an output of the second DC-DC converter 110*b*, Thus, the first and second selection circuits 150*a* and 150*b* may select the second conversion voltage Vout2. Accordingly, the first and second LDO regulators 120*a* and 120*b* may respectively generate the output voltages V1 and V2 from the second conversion voltage Vout2.

The third trough nth selection control signals MC3 and MCn may indicate a selection of an output of the first DC-DC converter 110*a*. Thus, the third and nth selection circuits 150*c* and 150*n* may select the first conversion voltage Vout1. Accordingly, the third and nth LDO regulators 120*c* and 120*n* may respectively generate the output voltages V3 and Vn from the first conversion voltage Vout1.

Referring to FIG. 12B, the controller 140*d* may generate the first through nth selection control signals MCa through MCn based on a predetermined (e.g., maximum) value of the output voltages V1 through Vn of the first through nth LDO regulators 120*a* through 120*n* and a drop-out voltage margin during an operation of the electronic device 10*d*. The drop-out voltage margin may be determined, for example, based on the current information I1 through In from the first through nth current detectors 130*a* through 130*n*. The first through third LDO regulators 120*a* through 120*c* may be in a second LDO regulator group 120B 'm and the nth LDO regulator 120*n* may be in a first LDO regulator group 120A' according to the first through nth selection control signals MCa through MCn. For example, the third LDO regulator 120*c* may be changed from the first LDO regulator group 120A ' to the second LDO regulator group 120B'.

The voltage level of the first conversion voltage Vout1 may be, for example, greater than a voltage level of the second conversion voltage Vout2. The third LDO regulator 120*c* may be initially connected to the first DC-DC converter 110*a*, for example, as in FIG. 12A. The controller 140*d* may estimate that a drop-out voltage of the third LDO regulator 120*c* is reduced, based on current information 13 from the third current detector 130*c*, when an output current of the third current detector 130*c* is reduced. The controller 140*d* may generate the third selection control signal MCc to allow the third LDO regulator 120*c* to be connected to the second DC-DC converter 110*b*. The third selection circuit 150*c* may select the second conversion voltage Vout2 based on the selection control signal MCc, and may provide the selected second conversion voltage Vout2 to the third LDO regulator 120*c*.

Figure 13:
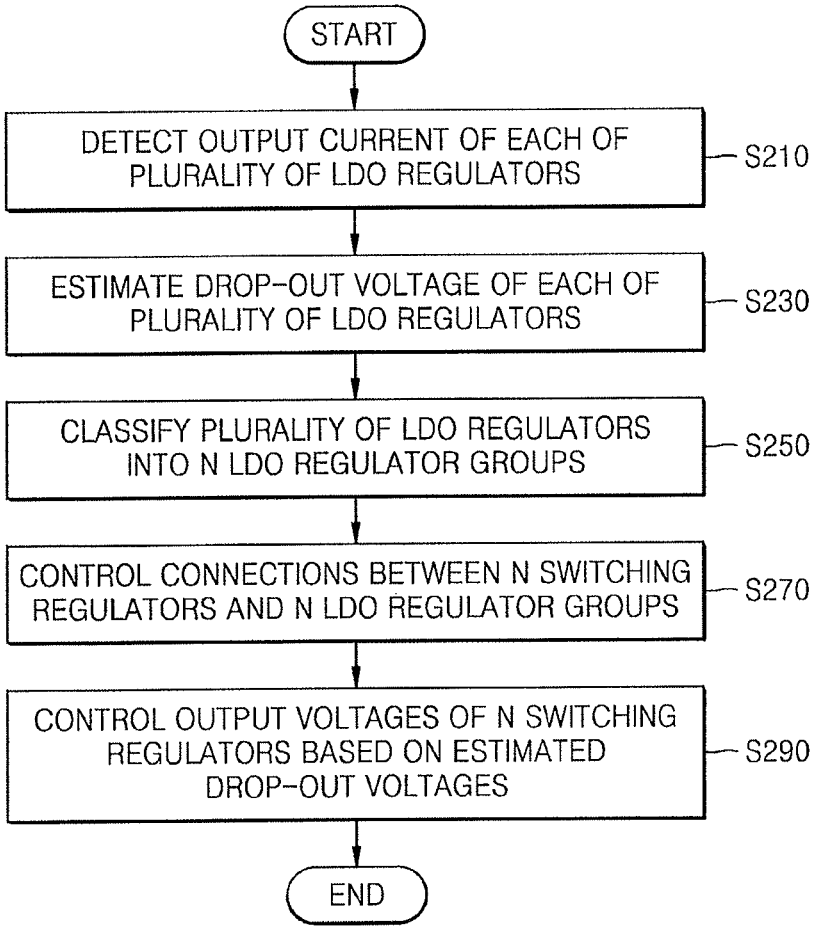
FIG. 13 illustrates another embodiment of a control method of a power management device.

FIG. 13 illustrates another embodiment of a control method performed by a power management device. The power management device may include regulators with a multistep structure. The method may controls an output voltage of a front regulator based on a consumption current of a rear regulator. Also, the control method may be time-serially performed by the power management device 100*d* of FIG. 11.

Referring to FIG. 13, in operation S210, an output current of each of a plurality of LDO regulators may be detected. For example, the current detectors 130*a* through 130*n* may respectively detect an output current of each of the LDO regulators 120*a* through 120*n*. In operation S230, a drop-out voltage of each of the LDO regulators may be estimated. For example, the controller 140*d* may estimate the drop-out voltage of each of the LDO regulators 120*a* through 120*n* based on the output current of each of the LDO regulators 120*a* through 120*n*.

In operation S250, the LDO regulators may include N LDO regulator groups, where N corresponds to the number of DC-DC converters in the power management device 100*d*. LDO regulators in the same LDO regulator group may receive and generate output voltages based on the same voltage. The same voltage may be a conversion voltage output from a DC-DC converter corresponding to the LDO regulator group.

In operation S270, connections between N switching regulators and the N LDO regulator groups may be controlled. For example, the controller 140*d* may generate the selection control signals MCa through MCn based on the estimated drop-out voltages. The selection control signals MCa through MCn may be respectively provided to the selection circuits 150*a* through 150*n*. Accordingly, input voltages with respect to the LDO regulators 120*a* through 120*n* may be changed in real time. Accordingly, the conversion efficiency of the LDO regulators 120*a* through 120*n* may be improved.

In operation S290, output voltages of the N switching regulators may be controlled based on the estimated drop-out voltages. For example, the controller 140*d* may control the first and second conversion voltages Vout1 and Vout2 that are output from the first and second DC-DC converters 110*a* and 110*b* based on the estimated drop-out voltages. For example, the controller 140*d* may control the first and second conversion voltages Vout1 and Vout2 based on a predetermined (e.g., maximum) value of output voltages of the first through nth LDO regulators 120*a* through 120*n* and a drop-out voltage margin.

Figure 14:
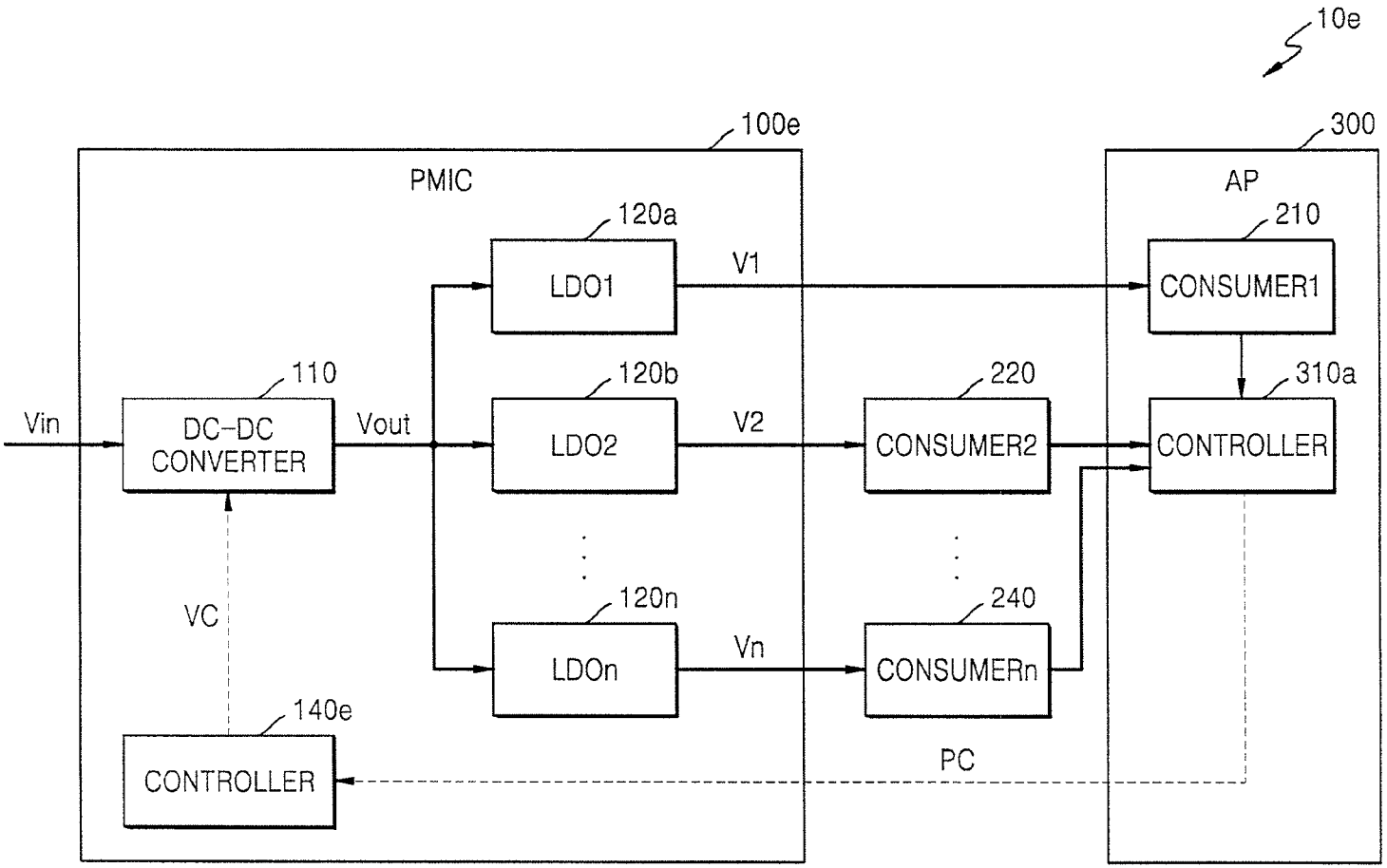
FIG. 14 illustrates another embodiment of a control method of a power management device.

FIG. 14 illustrates an embodiment of an electronic device 10*e* including a power management device 100*e*. Referring to FIG. 14, the electronic device 10*e* may include the power management device 100*e*, an application processor (AP) 300, and the second through nth consumers 220 through 240. The AP 300 may include a controller 310*a* and the first consumer 210. In the present embodiment, the first consumer 210 may be a functional block of the AP 300, and the second through nth consumers 220 through 240 may correspond to chips, modules, or functional blocks other than the AP 300. The AP 300 may generally control operation of the electronic device 10*e* and may be implemented, for example, as a system-on-chip (SoC).

The controller 310*a* may determine an operation state of each of the first through nth consumers 210 through 240 (e.g., functional blocks), generate a power control signal PC based on the determined operation state, and provide the generated power control signal PC to the power management device 100*e*. Accordingly, the controller 310*a* may be referred to as a power controller. For example, the controller 310*a* may estimate drop-out voltages of the LDO regulators 120*a* through 120*n* based on the determined operation state and generate the power control signal PC for dynamically controlling the conversion voltage Vout based on the estimated drop-out voltages.

In an embodiment, the first consumer 210 may be a multimedia block, and the controller 310*a* may determine an operation state of the first consumer 210. For example, when the electronic device 10*e* reproduces a music file, the controller 310*a* may determine that the first consumer 210 is in an active state and predict that a consumption current of the first consumer 210 is high. When electronic device 10*e* does not reproduce the music file, the controller 310*a* may determine that the first consumer 210 is in a standby state and predict that the consumption current of the first consumer 210 is low.

When the consumption current of the first consumer 210 is low (e.g., below a predetermined level), the controller 310*a* may estimate that a drop-out voltage of the first LDO regulator 120*a* is low since an output current of the first LDO regulator 120*a* connected to the first consumer 210 is also low. Thus, the controller 310*a* may generate the power control signal PC to reduce the conversion voltage Vout based on the estimated drop-out voltage of the first LDO regulator 120*a*.

In an embodiment, the second consumer 220 may be a communication chip, and the controller 310*a* may determine an operation state of the second consumer 220. For example, when the electronic device 10*e* performs a voice call, the controller 310*a* may determine that the second consumer 220 is in the active state and predict that the consumption current of the second consumer 220 is high (e.g., above a predetermined level). When the electronic device 10*e* does not perform the voice call, the controller 310*a* may determine that the second consumer 220 is in the standby state and predict that the consumption current of the second consumer 220 is low.

When the consumption current of the second consumer 220 is low (e.g., below a predetermined level), the controller 310*a* may estimate that a drop-out voltage of the second LDO regulator 120*b* is low since an output current of the second LDO regulator 120*b* connected to the second consumer 220 is also low. Thus, the controller 310*a* may generate the power control signal PC to reduce the conversion voltage Vout based on the estimated drop-out voltage of the second LDO regulator 120*b*.

As described above, according to the present embodiment, operation states of the consumers 210 through 240 may be determined and drop-out voltages of the plurality of LDO regulators 120*a* through 120*n* may be estimated based on the determined operation states, without directly detecting output current of the LDO regulators 120*a* through 120*n*. Thus, the conversion efficiency of an entire power management module may be improved without having to change hardware elements of the power management module.

The power management device 100*e* may include the DC-DC converter 110, the LDO regulators 120*a* through 120*n*, and a controller 140*e*. The controller 140*e* may generate the voltage control signal VC for controlling the conversion voltage Vout based on a predetermined (e.g., maximum) value of the output voltages V1 through Vn of the the LDO regulators 120*a* through 120*n* (e.g., a maximum output voltage), and the power control signal PC. The generated voltage control signal VC may be provided to the DC-DC controller 110. Accordingly, the DC-DC controller 110 may provide the changed conversion voltage Vout, thereby improving the conversion efficiency of the entire power management device 100*e*.

Figure 15:
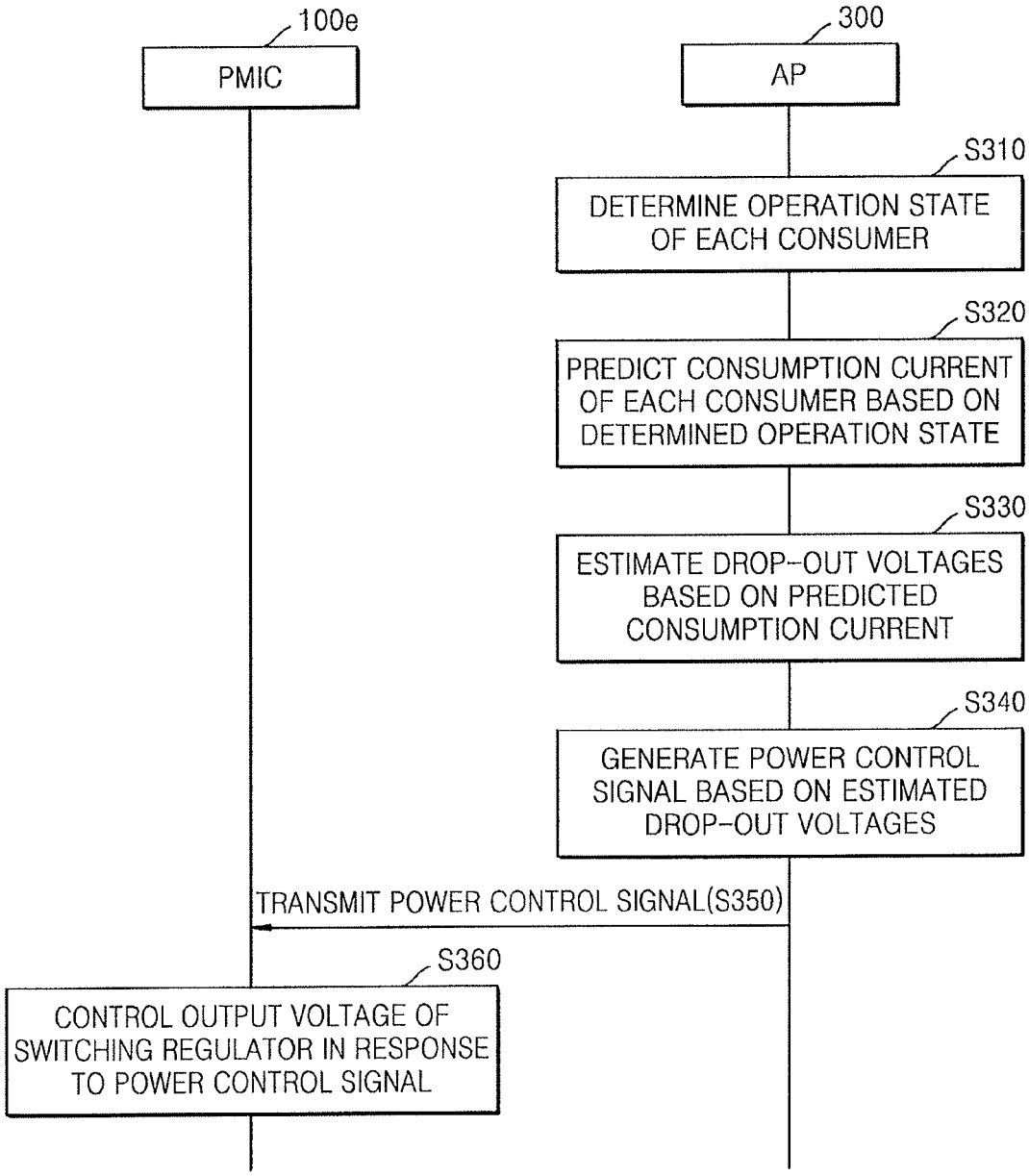
FIG. 15 illustrates an embodiment of operations between the power management device and applicator processor of FIG. 14.

FIG. 15 illustrates an embodiment of operations of the power management device 100*e* and the AP 300 of FIG. 14. Referring to FIG. 15, in operation S310, the AP 300 determines an operation state of each consumer. In operation S320, the AP 300 predicts consumption current of each consumer based on the determined operation state. In operation S330, the AP 300 estimates drop-out voltages based on the predicted consumption current. In operation S340, the AP 300 generates a power control signal based on the estimated drop-out voltages. In operation S350, the AP 300 transmits the power control signal to the power management device 100*e*. In operation S360, the power management device 100*e* controls an output voltage of a switching regulator (e.g., a DC-DC converter) based on the power control signal.

Figure 16:
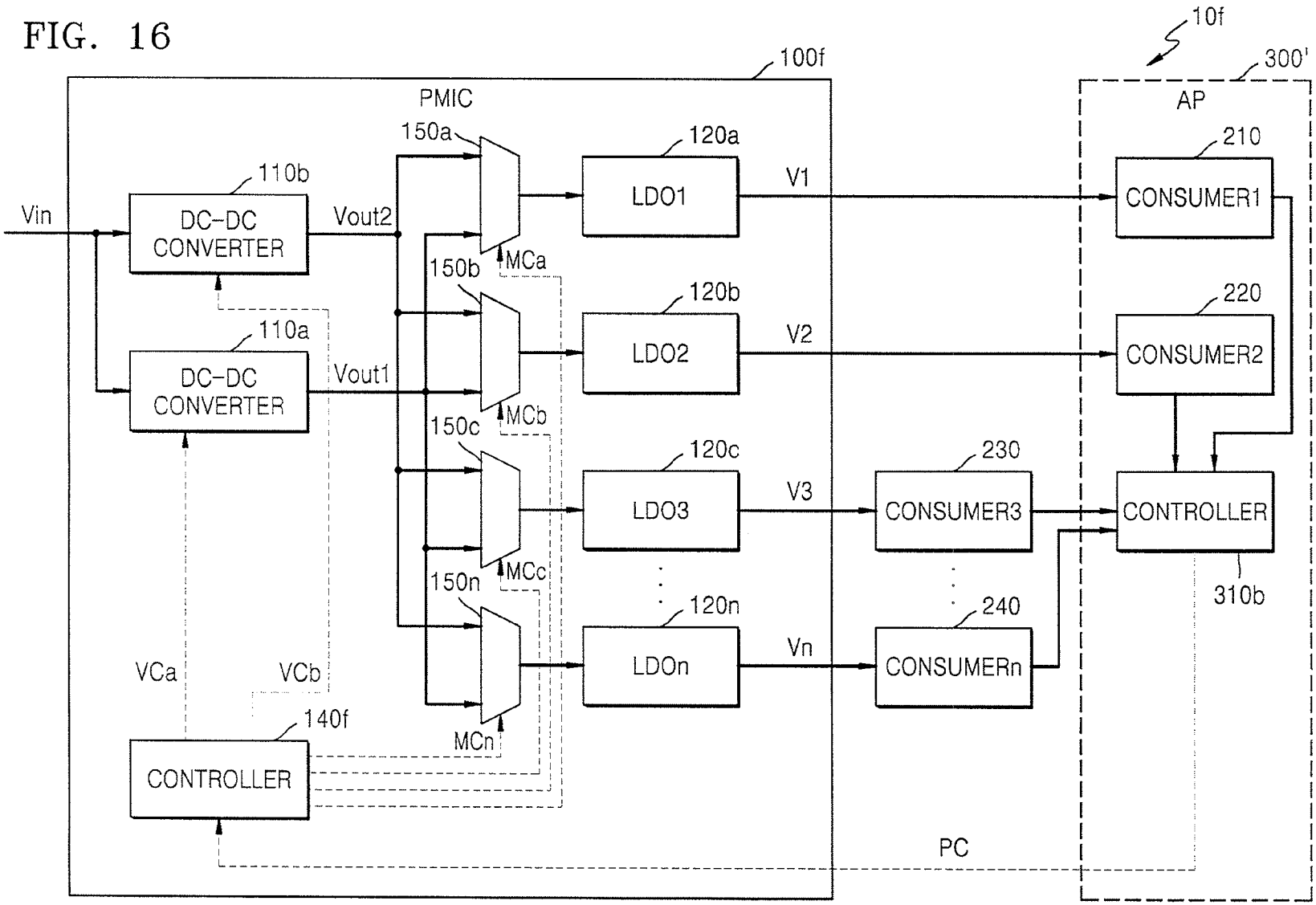
FIG. 16 illustrates another embodiment of an electronic device including a power management device.

FIG. 16 illustrates an embodiment of an electronic device 10*f* including a power management device 100*f*. Referring to FIG. 16, the electronic device 10*f* may include the power management device 100*f*, an AP 300', and the third and nth consumers 230 and 240. The AP 300' may include a controller 310*b* and the first and second consumers 210 and 220. In the present embodiment, the first and second consumers 210 and 220 may be functional blocks of the AP 300', and the third and nth consumers 230 and 240 may correspond to chips, modules, or functional blocks other than the AP 300'. The AP 300' may control operation of the electronic device 10*f* and may be implemented, for example, as a SoC.

The controller 310*b* may determine an operation state of each of the first through nth consumers 210 through 240 (e.g., functional blocks), generate the power control signal PC based on the determined operation state, and provide the generated power control signal PC to the power management device 100*f*. Accordingly, the controller 310*b* may be referred to as a power controller. The controller 310*b* may estimate drop-out voltages of the plurality of LDO regulators 120*a* through 120*n* based on the determined operation state and generate the power control signal PC for dynamically controlling the first and second conversion voltages Vout1 and Vout2 based on the estimated drop-out voltages.

The power management device 100*f* may include the first and second DC-DC converters 110*a* and 110*b*, the LDO regulators 120*a* through 120*n*, a controller 140*f*, and the selection circuits 150*a* through 150*n*. The controller 140*f* may generate the first and second voltage control signals VCa and VCb for respectively controlling the first and second conversion voltages Vout1 and Vout2 based on a predetermined (e.g., maximum) value of the output voltages V1 through Vn of the LDO regulators 120*a* through 120*n* (e.g., a maximum output voltage), and the power control signal PC. The generated first and second voltage control signals VCa and VCb may be respectively provided to the first and second DC-DC converters 110*a* and 110*b*.

The controller 140*f* may also generate the selection control signals MCa through MCn based on the power control signal PC. The generated selection control signals MCa through MCn may be respectively provided to the selection circuits 150*a* through 150*n*, to thereby control connections between the first and second DC-DC converters 110*a* and 110*b* and the LDO regulators 120*a* through 120*n*. Each of the selection circuits 150*a* through 150*n* may select one of the first or second conversion voltages Vout1 and Vout2 based on a respective ones of the selection control signals MCa through MCn. The selected conversion voltage Vout1 or Vout2 may be provided to an LDO regulator connected thereto.

Figure 17:
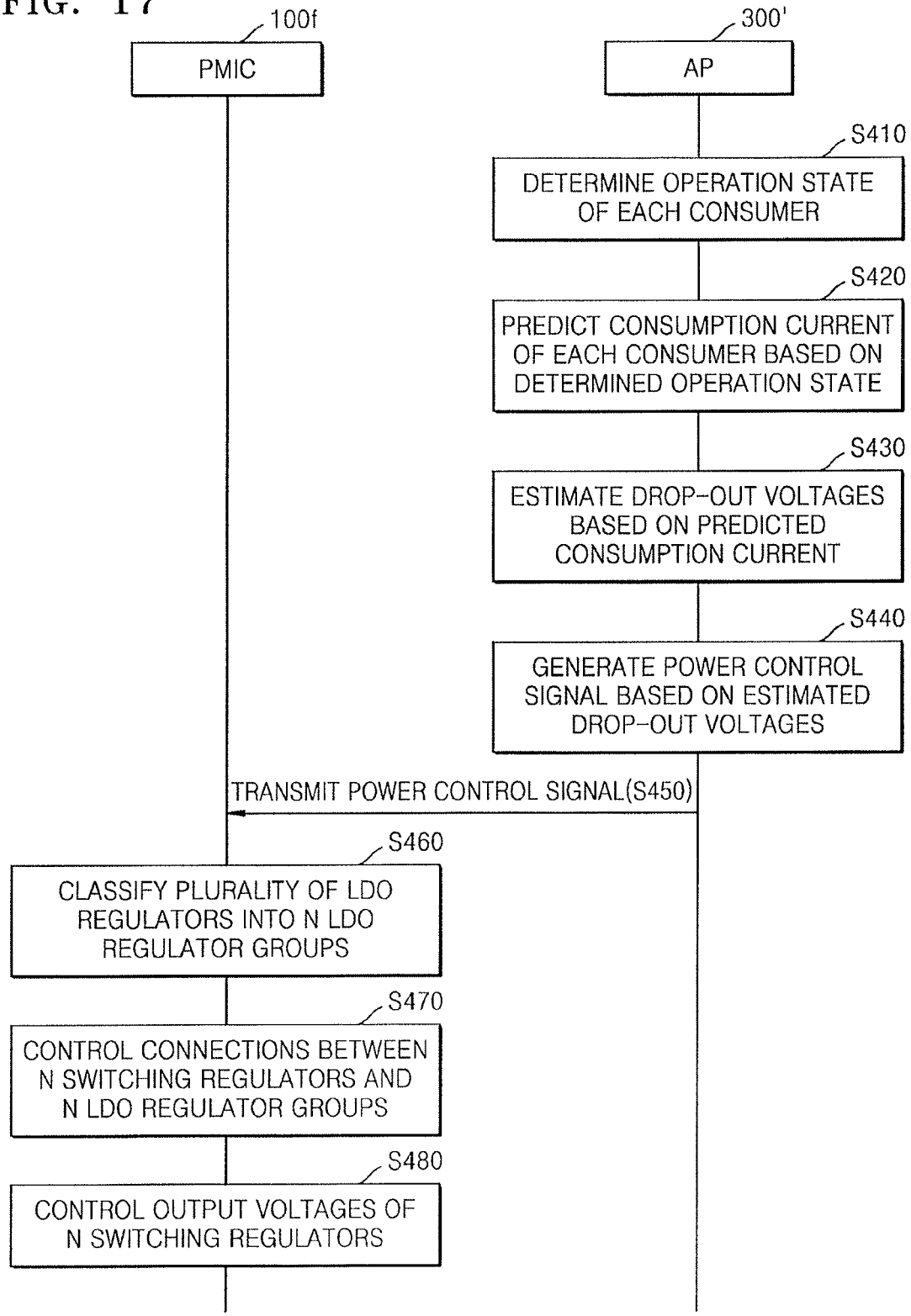
FIG. 17 illustrates an embodiment of operations between the power management device and applicator processor of FIG. 16.

FIG. 17 illustrates an embodiment of operations of the power management device 100*f* and the AP 300' of FIG. 16. Referring to FIG. 17, in operation S410, the AP 300' determines an operation state of each consumer. In operation S420, the AP 300' predicts consumption current of each consumer based on the determined operation state. In operation S430, the AP 300' estimates drop-out voltages based on the predicted consumption current. In operation S440, the AP 300' generates a power control signal based on the estimated drop-out voltages. In operation S450, the AP 300' transmits the power control signal to the power management device 100*f*.

In operation S460, the power management device 100*f* classifies a plurality of LDO regulators into N LDO regulator groups. In operation S470, the power management device 100*f* controls connections between N switching regulators and the N LDO regulator groups. In operation S480, the power management device 100*f* controls output voltages of the N switching regulators, e.g., the first and second DC-DC converters 110*a* and 110*b*, based on the power control signal.

Figure 18:
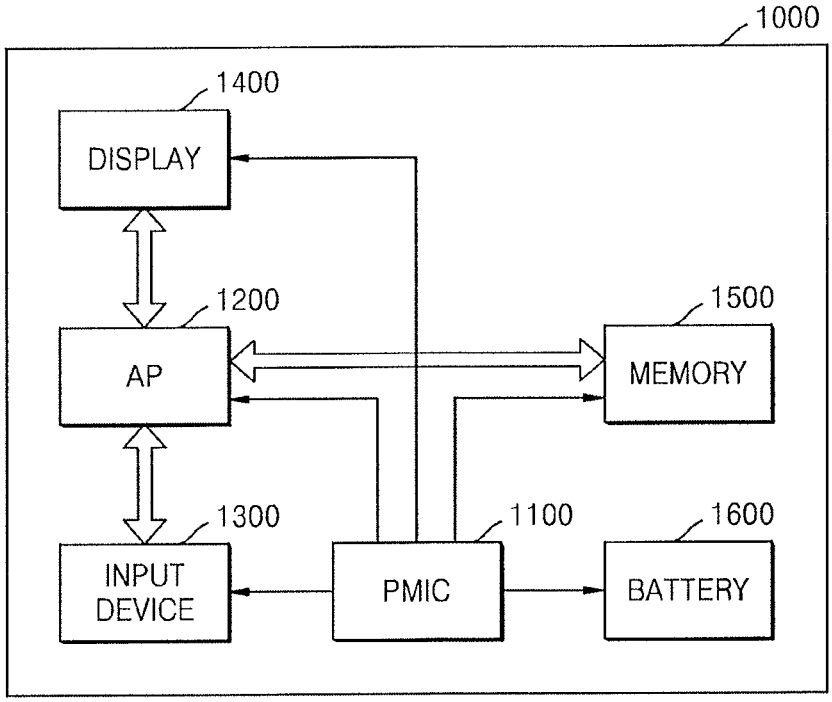
FIG. 18 illustrates another embodiment of an electronic device.

FIG. 18 illustrates an embodiment of an electronic device 1000 which may include a power management device 1100, an AP 1200, an input device 1300, a display 1400, a memory 1500, and a battery 1600. The electronic device 1000 may be, for example, a smart phone, a personal computer (PC), a tablet PC, a netbook, an E-reader, a personal digital assistant (PDA), a portable multimedia player (PMP), an MP3 player, or another device. The electronic device 1000 may also be a wearable device such as an electronic bracelet, an electronic necklace, or another item worn on the body.

The power management device 1100 may receive power form the battery 1600 and manage power of the AP 1200, the input device 1300, the display 1400, or the memory 1500. The AP 1200 may control general operations of the electronic device 1000. For example, the AP 1200 may display data stored in the memory 1500 on the display 1400 according to an input signal generated by the input device 1300. For example, the input device 1300 may be, for example, a touch pad or a pointing device such as a computer mouse, a keypad, or a keyboard.

The controllers, devices, converters, detectors, regulators, LDOs, and other processing features of the disclosed embodiments may be implemented in logic which, for example, may include hardware, software, or both. When implemented at least partially in hardware, the controllers, devices, converters, detectors, regulators, LDOs, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, devices, converters, detectors, regulators, LDOs, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A power management device, comprising:

first and second switching regulators to respectively generate first and second conversion voltages from an input voltage;

a plurality of low drop-out (LDO) regulators to generate a plurality of output voltages from the first and second conversion voltages; and a controller to estimate drop-out voltages of the LDO regulators based on output currents of the LDO regulators, generate a plurality of voltage control signals based on the estimated drop-out voltages, and respectively provide the plurality of voltage control signals to the first and second switching regulators in order to dynamically control the first and second conversion voltages.

2. The power management device as claimed in claim 1, wherein the controller is to generate a first voltage control signal among the plurality of voltage control signals to control the first conversion voltage based on a maximum value of the corresponding output voltages and the estimated drop-out voltages, and to provide the first voltage control signal to the first switching regulator.

3. The power management device as claimed in claim 1, wherein the controller is to control the first switching regulator so that the first conversion voltage is greater than a sum of a maximum value of the corresponding output voltages and a drop-out voltage margin that corresponds to the estimated drop-out voltages.

4. The power management device as claimed in claim 1, wherein the first switching regulator includes a DC-DC converter.

5. The power management device as claimed in claim 1, further comprising a plurality of current detectors to detect output currents of the LDO regulators and to provide current information based on the detected output currents to the controller.

6. The power management device as claimed in claim 1, wherein:

the LDO regulators are classified into first and second LDO regulator groups respectively corresponding to the first and second switching regulators, the controller is to generate a first voltage control signal to control the first conversion voltage based on output currents of the first LDO regulator group, and generate a second voltage control signal to control the second conversion voltage based on output currents of the second LDO regulator group, and the controller is to respectively provide the first and second voltage control signals to the first and second switching regulators.

7. The power management device as claimed in claim 1, further comprising:

a plurality of selection circuits respectively connected to the LDO regulators, wherein each of the selection circuits is to select one of the first or second conversion voltages based on a corresponding selection control signal, and is to provide the selected first or second conversion voltage to the LDO regulator connected thereto.

8. The power management device as claimed in claim 7, wherein:

the controller is to generate a plurality of selection control signals based on output currents of the LDO regulators and respectively provide the selection control signals to the selection circuits to control connections between the first and second switching regulators and the LDO regulators.

9. An electronic device, comprising:

a power management device to provide a plurality of output voltages to drive a plurality of functional blocks based on an input voltage; and an application processor (AP) to determine an operation state of each of the functional blocks, generate a power control signal based on the operation state, and provide the generated power control signal to the power management device, wherein the power management device includes:

first and second switching regulators to respectively generate first and second conversion voltages from the input voltage;

a plurality of low drop-out (LDO) regulators to generate a plurality of output voltages from the first and second conversion voltages, the output voltages being provided to the functional blocks;

a plurality of selectors respectively connected to the LDO regulators;

a controller that receives the power control signal, the controller to control the first and second conversion voltages based on the power control signal; and a plurality of current detectors to detect output currents of the LDO regulators and to provide the detected output currents to the controller, the AP includes a power controller to estimate drop-out voltages of the LDO regulators based on the determined operation state of the each of the functional blocks receiving the output voltages from the LDO regulators, and to generate the power control signal, and the controller included in the power management device generates a plurality of selection control signals and respectively provides the selection control signals to the selectors to control connections between the first and second switching regulators and the LDO regulators.

10. The electronic device as claimed in claim 9, wherein the power controller is to generate a voltage control signal to control the first conversion voltage based on a maximum value of the corresponding output voltages and the power control signal and to provide the voltage control signal to the first switching regulator.

11. The electronic device as claimed in claim 9, wherein each of the selectors is to select one of the first or second conversion voltages based on a corresponding selection control signal and is to provide the selected first or second conversion voltage to the LDO regulator connected thereto.

* * * * *